US008475183B2

(12) United States Patent
Chien et al.

(10) Patent No.: US 8,475,183 B2
(45) Date of Patent: Jul. 2, 2013

(54) ELECTRICAL CONNECTOR WITH IMPROVED IMPEDANCE CONTINUITY

(75) Inventors: Chih-Ming Chien, New Taipei (TW); Feng Pan, Kunshan (CN)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 42 days.

(21) Appl. No.: 13/225,721

(22) Filed: Sep. 6, 2011

(65) Prior Publication Data

US 2012/0058655 A1 Mar. 8, 2012

(51) Int. Cl.
*H01R 12/00* (2006.01)

(52) U.S. Cl.
USPC ..... 439/78; 439/101

(58) Field of Classification Search
USPC ..... 439/78, 101, 607.08, 607.11
See application file for complete search history.

(56) References Cited

U.S. PATENT DOCUMENTS 4,686,607 A * 8/1987 Johnson ..... 361/788
5,522,730 A * 6/1996 Soes et al. ..... 439/78
5,931,686 A * 8/1999 Sasaki et al. ..... 439/78
6,146,157 A * 11/2000 Lenoir et al. ..... 439/101
6,254,400 B1 * 7/2001 Yodogawa ..... 439/78
6,500,029 B2 * 12/2002 Nitta ..... 439/607.11
6,764,320 B1 * 7/2004 Lenoir et al. ..... 439/101
7,086,871 B2 * 8/2006 Park ..... 439/78
7,331,802 B2 * 2/2008 Rothermel et al. ..... 439/108
7,621,781 B2 * 11/2009 Rothermel et al. ..... 439/607.05
7,666,009 B2 * 2/2010 Minich et al. ..... 439/101
7,837,505 B2 * 11/2010 Minich et al. ..... 439/607.08
7,914,305 B2 * 3/2011 Amleshi et al. ..... 439/101

* cited by examiner

*Primary Examiner* — Thanh Tam Le
(74) *Attorney, Agent, or Firm* — Ming Chieh Chang; Wei Te Chung

(57) ABSTRACT

An electrical connector (100) includes a middle board (4) defining a plurality of receiving holes (41, 42), a first insulative housing (1) mounted on one side of the middle board and defining a first receiving room (13), and a number of contacts (3) mounted on the first insulative housing. The contacts include a number of signal contacts (S) and a number of grounding contacts (G). Each of contacts includes a first mating portion (31), a second mating portion (32), and a middle portion (33) between the first and the second mating portions. The middle portions extend beyond the first insulative housing and are received in the receiving holes. Each of the middle portions of the signal contacts is solid. Each of the middle portions of the grounding contacts has a through hole (331) and has an outer profile wider than that of middle portion of the signal contact.

6 Claims, 5 Drawing Sheets

ELECTRICAL CONNECTOR WITH IMPROVED IMPEDANCE CONTINUITY

BACKGROUND OF THE INVENTION

1. Field of the Invention

The present invention relates to an electrical connector, and more particularly to an electrical connector for communication applications.

2. Description of Related Arts

In communication applications, a header mated with a receptacle is widely used for transmitting high speed signal. U.S. Pat. No. 5,522,730, issued on Jun. 4, 1996, discloses a header. According to the disclosure, the header connector comprises a middle board, a first U-shaped insulative housing mounted on a surface of the middle board, a U-shaped second insulative housing mounted on an opposite surface of the middle board, and a plurality of contacts mounted on the first and the second insulative housings. The first insulative housing defines a first receiving room, and the second insulative housing defines a second receiving room. Each of the contacts comprises a first mating portion received in the first receiving room, a second mating portion received in the second receiving room, and a middle portion connecting between the first mating portion and the second portion. Each of the middle portions comprises a compliant pin portion for interference fitting with the middle board to retain the contacts on the middle board. The compliant pin portions will cause signal contact impedance discontinuity to thereby deteroirate high speed signal transmission.

Hence, an improved electrical connector is desired to offer advantages over the related art.

SUMMARY OF THE INVENTION

An object of the present invention is to provide an electrical connector having signal contacts with improved impendence continuity, and grounding contact stably mounted.

To achieve the above-mentioned object, an electrical connector, comprises a middle board defining a plurality of receiving holes, a first insulative housing mounted on one side of the middle board and defining a first receiving room for receiving a first mating connector, and a plurality of contacts mounted on the first insulative housing. The contacts comprise a plurality of signal contacts and a plurality of grounding contacts. Each of the signal contacts and the grounding contacts comprises a first mating portion, a second mating portion opposite to the first mating portion, and a middle portion between the first and the second mating portions. The middle portions extend beyond the first insulative housing and are received in the receiving holes of the middle board. Each of the middle portions of the signal contacts is solid. Each of the middle portions of the grounding contacts has a through hole and has an outer profile wider than that of middle portion of the signal contact.

According to the present invention, the middle portions of the signal contacts have a rigid structure to ensure the signal contacts having continuity impendence. The middle portions of the grounding contacts have a flexible structure to ensure the grounding contacts stably mounted on the first insulative housing.

DETAILED DESCRIPTION OF THE PREFERRED EMBODIMENT

Reference will now be made in detail to a preferred embodiment of the present invention.

Figure 1:
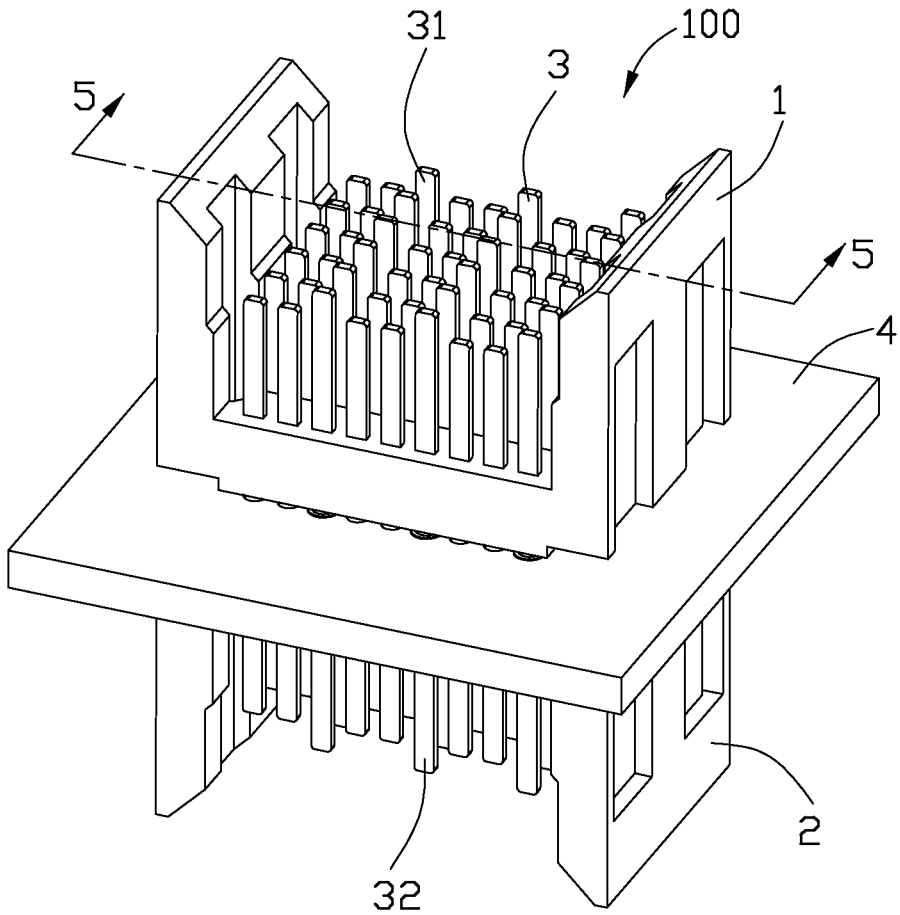
FIG. 1 is a perspective view of an electrical connector in accordance with the present invention.
Figure 2:
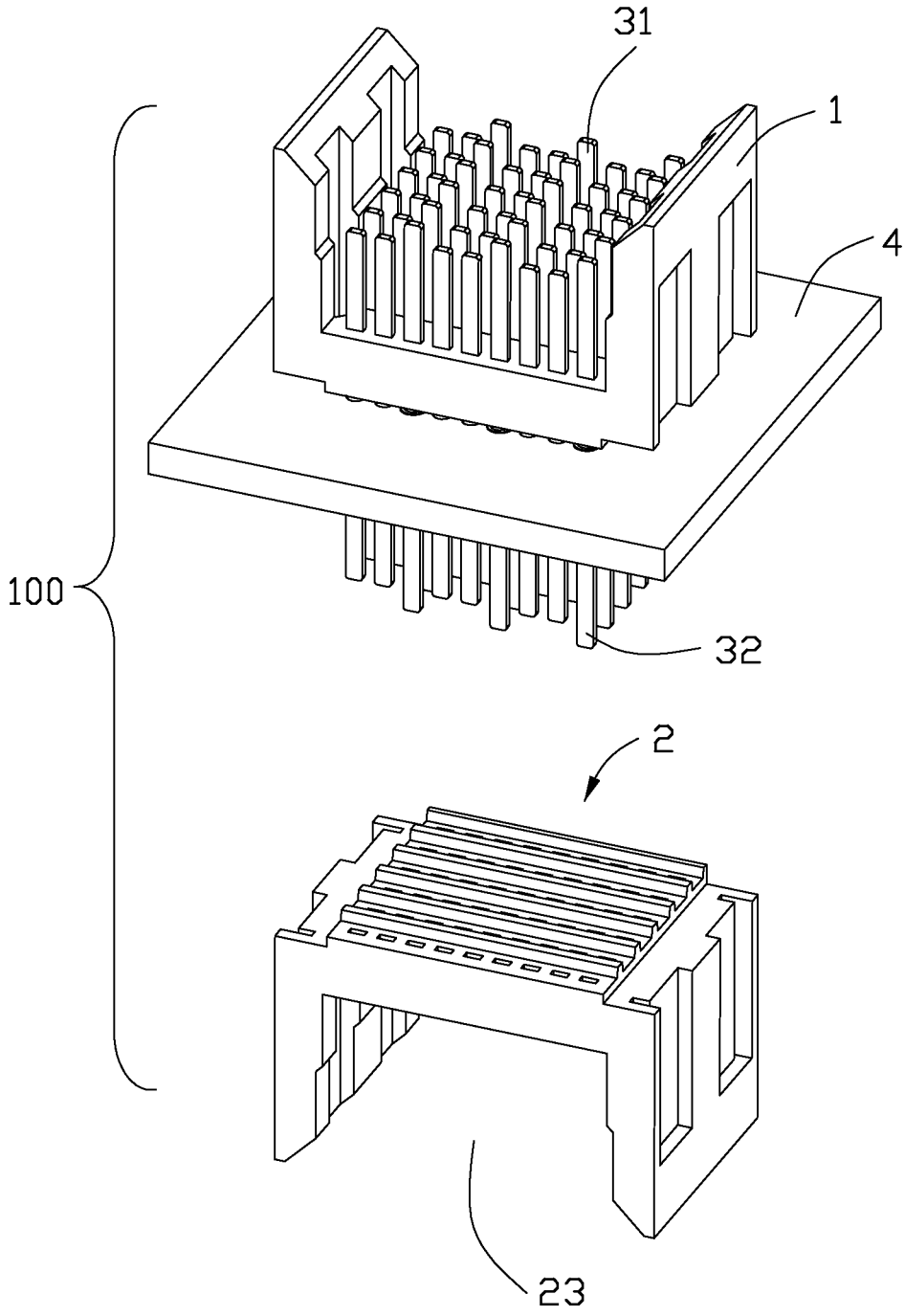
FIG. 2 is a partly exploded view of the electrical connector as shown in FIG. 1 showing the second insulative housing separated from the middle board.
Figure 3:
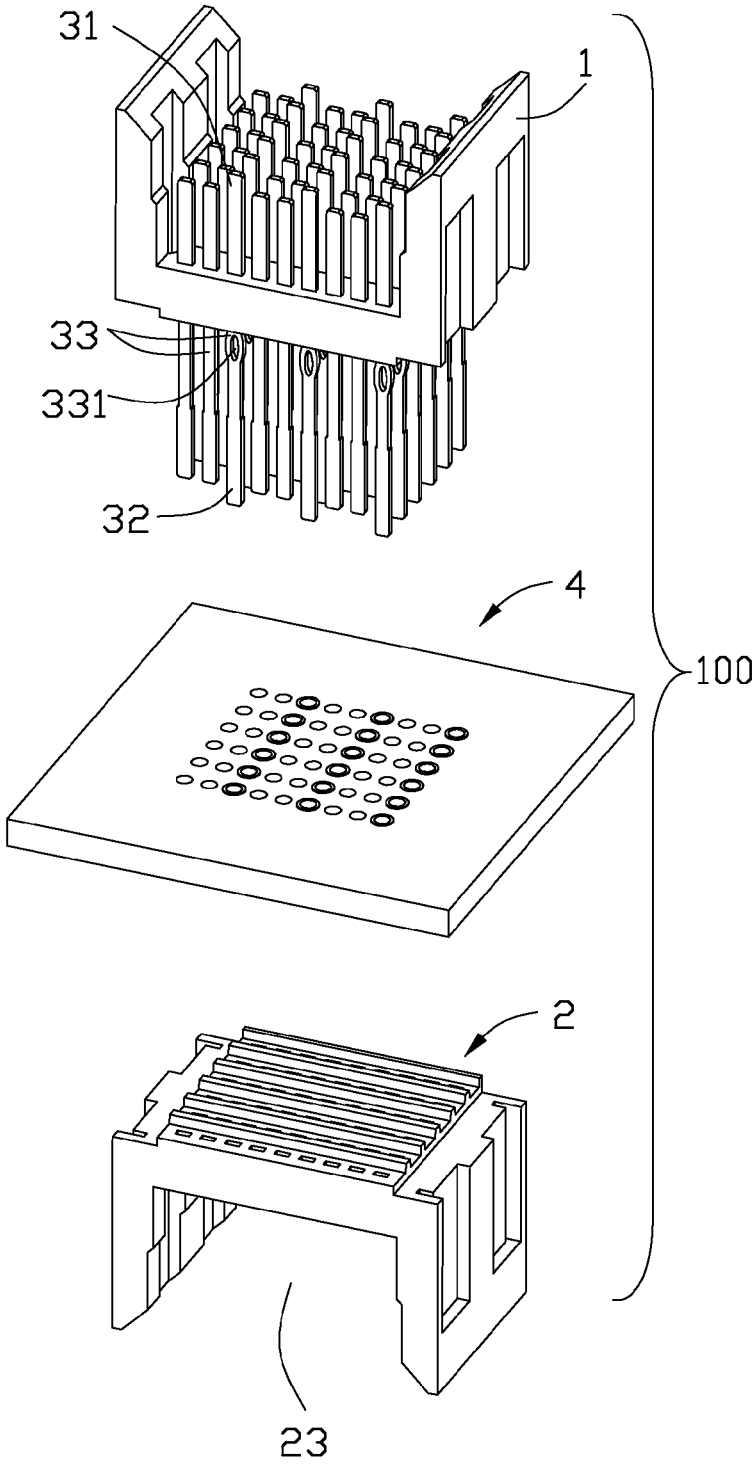
FIG. 3 is a partly exploded view of the electrical connector as shown in FIG. 2 further showing the first insulative housing separated from the middle board.

Referring to FIGS. 1 to 3, an electrical connector 100 comprises a middle board 4, a first insulative housing 1 mounted on a first surface of the middle board, and a second insulative housing 2 mounted on an second surface of the middle board opposite to the first surface, and a plurality of contacts mounted on the first and the second insulative housings 1, 2.

The first insulative housing 1 having an U shape comprises a first mounting wall 11 having opposite edges, a pair of first side walls 12 vertically extending from the opposite edges of the first mounting wall 11 along a first direction respectively, and a first receiving room 13 defined between the pair of first side walls 12 for receiving a first mating connector. The first mounting wall 11 comprises a plurality of first mounting holes 110 extending through the first mounting wall 11.

The second insulative housing 2 having a structure similar to the first insulative housing 1, comprises a second mounting wall 21 parallel to the first mounting wall 11 having opposite edges, a pair of second side walls 22 vertically extending from the opposite edges of the second mounting wall 21 along a second direction opposite to the first direction respectively, and a second receiving room 23 defined between the pair of the second side walls 22 for receiving a second mating connector. The first receiving room 13 has a first opening facing to the first direction, and the second receiving room 23 has a second opening facing to a second direction. The second mounting wall 21 comprises a plurality of second mounting holes 210 extending through the second mounting wall 21. The first side walls 12 are aligned with the pair second side walls 22 respectively.

The middle board 4 is sandwiched between the first insulative housing 1 and the second insulative housing 2, and defines a plurality of first and second receiving hole 41, 42 extending through the middle board 4 for receiving the contacts 3. The first receiving holes 41 don't coat any conductive material, and the second receiving holes 42 are coated with conductive layer 421.

The contacts 3 are arranged in matrix and comprise a plurality of signal contacts S and a plurality of grounding contacts G. Each of the signal contacts S and the grounding contacts comprises a first mating portion 31 received in the first receiving room 13, a second mating portion 32 received in the second receiving room 23, a middle portion 33 disposed between the first and the second mating portions 31, 32, a first mounting portion 34 connecting between the first mating portion 31 and the middle portion 33 and received in the first mounting wall 11, and a second mounting portion 35 connecting between the second mating portion 32 and the middle portion 33 and received in the second mounting wall 21. The first mating portions 31 extend through the first mounting holes 110 and are received in the first receiving room 13. The second mating portions 32 extend through the second mounting holes 210 and are received in the second receiving room 23. The first insulative housing 1 is separated apart from the second insulative housing 2. The middle portions 33 of the signal contacts S and the grounding contacts G are disposed between the first insulative housing 1 and the second insulative housing 2.

Figure 4:
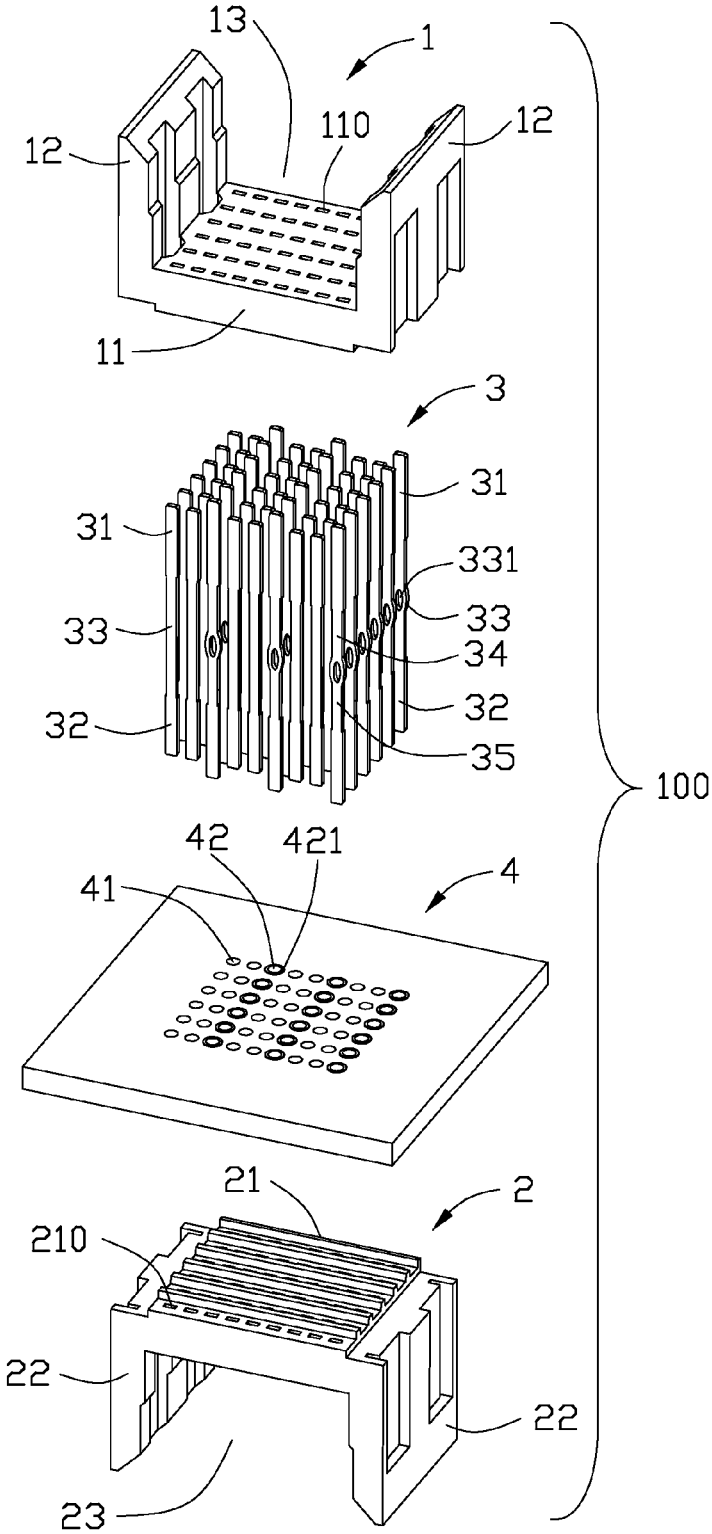
FIG. 4 is an exploded view of the electrical connector as shown in FIG. 1.
Figure 5:
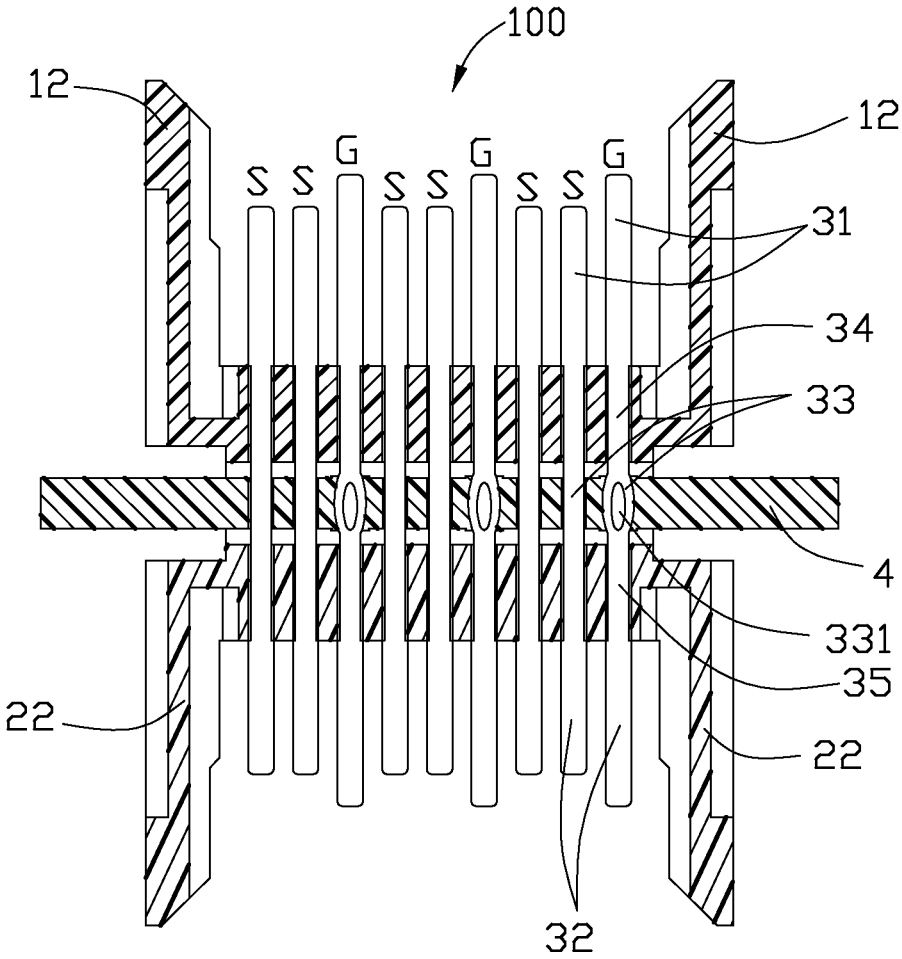
FIG. 5 is a cross-sectional view of the electrical connector taken along line 5-5 of FIG. 1.

Referring to FIGS. 4 and 5, the middle portions 33 of the grounding contacts G have a width larger than a width of the middle portions 33 of the signal contacts S. The signal contacts S and the grounding contacts G are configured to have retention between each of the signal contacts S and the middle board 4 is weaker than that between each of the grounding contacts G and the middle board 4. In this embodiment, each of the middle portions 33 of the grounding contacts G defines a through hole 331 to make the middle portion 33 of the grounding contact G compliant. The middle portions 33 of the grounding contacts G can be press fitted into the second receiving holes 42 of the middle board 4 to electrically connect with the conductive layer 421. Therefore, the grounding contacts G have an improved grounding performance, and are stably retained in the middle board 4. The middle portions 33 of the signal contacts S have a rigid structure and are received in the first receiving holes 41 of the middle board 4. The signal contacts S have a flat shape without any through hole. The middle portions 33 of the signal contacts S have a radial dimension smaller than a radial dimension of the first receiving hole 41. The signal contacts S loose fit with the first receiving holes 41, and insulate with the first receiving holes 41. Therefore, the signal contacts S can keep impedance continuity. The first mounting portions 34 of the contacts 3 have an interference with the first mounting holes 110 to retain the contacts 3 on the first insulative housing 1, and the second mounting portions 35 of the contacts 3 have an interference fit with the second mounting holes 210 to retain the contacts 3 on the second insulative housing 2.

Referring to FIGS. 4 and 5, the middle portions 33 of the signal contacts S are thinner than the first and the second mating portions 31, 32 of the signal contacts S to make the impedance of the signal contacts S matching the impedance of the system. The first mating portions 31 of the signal contacts S are shorter than the first mating portions 31 of the grounding contacts G, and the second mating portions 32 of the signal contacts S are shorter than the second mating portions 32 of the grounding contacts G to improve the shielding performance.

It is to be understood, however, that even though numerous characteristics and advanarmes of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector, comprising:

a middle board defining a plurality of receiving holes;

a first insulative housing mounted on one side of the middle board and defining a first receiving room for receiving a first mating connector;

a plurality of contacts mounted on the first insulative housing, the contacts comprising a plurality of signal contacts and a plurality of grounding contacts, each of the signal contacts and the grounding contacts comprising a first mating portion received in the first receiving room, a second mating portion opposite to the first mating portion, and a middle portion between the first and the second mating portions, the middle portions extending beyond the first insulative housing and received in the receiving holes of the middle board, each of the middle portions of the signal contacts being solid, and each of the middle portions of the grounding contacts having a through hole and having an outer profile wider than that of the middle portion of the signal contact; and a second insulative housing on the other side of the middle board opposite the first insulative housing, the second insulative housing comprising a second receiving room for receiving a second mating connector;

wherein the middle portions of the signal contacts and the middle portions of the grounding contacts are disposed at a same level; and wherein the middle board is sandwiched between the first insulative housing and the second insulative housing, the middle portions of the signal contacts and the middle portions of the grounding contacts being receiving in the receiving holes;

wherein the receiving holes for receiving the middle portions of the signal contacts are free of any conductive material so as to be insulated from the signal contacts, and the receiving holes for receiving the middle portions of the grounding contacts are coated with conductive material to electrically connect with the grounding contacts;

wherein the middle portions of the signal contacts are thinner than the first and the second mating portions of the signal contacts; and wherein the first mating portions of the signal contacts are shorter than the first mating portions of the grounding contacts, and the second mating portions of the signal contacts are shorter than the second mating portions of the grounding contacts.

2. The electrical connector as recited in claim 1, wherein the second mating portions of the signal contacts and the second mating portions of the grounding contacts are received in the second receiving room, and the middle portions of the signal contacts and the middle portions of the grounding contacts are disposed between the first insulative housing and the second insulative housing.

3. The electrical connector as recited in claim 1, wherein the first insulative housing comprises a first mounting wall having a pair of opposite edges, and a pair of first side walls vertically extending from the opposite edges of the first mounting wall respectively, the first receiving room defined between the pair of the first side walls.

4. The electrical connector as recited in claim 3, wherein the second insulative housing comprises a second mounting wall having a pair of opposite edges, and a pair of second side walls vertically extending from the opposite edges respectively, the second receiving room defined between the pair of the second side walls.

5. The electrical connector as recited in claim 4, wherein each of the signal contacts and the grounding contacts comprises a first mounting portion mounted on the first mounting wall and connecting between the first mating portion and the middle portion, and a second mounting portion mounted on the second mounting wall and connecting between the second mating portion and the middle portion.

6. An electrical connector assembly comprising:

a printed circuit board defining thereof two opposite first and second surfaces to respectively form first and second receiving space thereon;

a first set of through holes defined in the printed circuit board and extending through both said first and second surfaces without conductive layer coated therein;

a second set of through holes defined in the printed circuit board and intermixed with the first set of through holes and extending through both said first and second surfaces with conductive layer coated therein;

a first set of pin type signal contacts extending through the first set of corresponding through holes, respectively, with opposite first and second end regions disposed in the corresponding first and second receiving spaces;

a second set of pin type signal contacts extending through the second set of corresponding through holes, respectively, with opposite first and second end sections disposed in the corresponding first and second receiving spaces; first and second connectors respectively mounted upon the first surface and second surface, wherein the first connector encloses the first end regions and the first end sections, and the second connector encloses the second end regions and the second end sections;

wherein the first set of contacts are signal contacts while the second set of contacts are grounding contacts and said second set of contacts are longer than the first set of contacts;

wherein the second set of contacts define compliant middle sections for retention with regard to the printed circuit board; and wherein said first set of contacts and said second set of contacts are configured to have retention between each of the first set of contacts and the printed circuit board is weaker than that between each of the second set of contacts and the printed circuit board.

* * * * *